US005275278A

United States Patent [19]

Henry et al.

[11] Patent Number: 5,275,278

[45] Date of Patent: Jan. 4, 1994

[54] GOLF CLUB SHAFT PROTECTOR

[75] Inventors: Christopher J. Henry, St. Louis; Lawrence R. Diener, Fenton; Joseph J. Ventimiglia, St. Louis, all of Mo.

[73] Assignee: Sinclair & Rush, Inc., St. Louis, Mo.

[21] Appl. No.: 966,387

[22] Filed: Oct. 26, 1992

[51] Int. Cl.[5] ..... A63B 57/00

[52] U.S. Cl. ..... 206/315.6; 206/315.2; 150/160

[58] Field of Search ..... 206/315.2, 315.3, 315.6; 150/160

[56] References Cited

U.S. PATENT DOCUMENTS

| | | | |
|---|---|---|---|
| 2,879,819 | 3/1959 | Turnbull | 206/315.4 |
| 3,967,667 | 7/1976 | Robinson | 206/315.6 |
| 3,985,229 | 10/1976 | Maki | 206/315.6 |
| 4,194,547 | 3/1980 | Sidor et al. | 206/315.6 |
| 4,664,382 | 5/1987 | Palmer et al. | 206/315.6 X |
| 4,911,465 | 3/1990 | Hauer | 206/315.6 X |
| 4,932,523 | 6/1990 | Yamazoe | 206/315.6 |
| 4,938,349 | 7/1990 | Burns | 206/315.6 |
| 4,944,396 | 7/1990 | Larkin | 206/315.6 |
| 5,088,600 | 2/1992 | Kopp, Jr. | 206/315.2 |
| 5,094,345 | 3/1992 | Yonnetti | 206/315.3 X |

*Primary Examiner*—Sue A. Weaver

*Attorney, Agent, or Firm*—Polster, Lieder, Woodruff & Lucchesi

[57] ABSTRACT

A golf club shaft protector is disclosed as including a hollow plastic tube of predetermined diameter and length with open upper and lower ends. The length of the hollow plastic tube substantially corresponds to the length of a golf club shaft and can be pre-selected and cut to the appropriate length. A flexible restricted throat element extends across the open upper end of the hollow plastic tube for resilient deformation upon the insertion of a golf club handle to allow passage of the golf club handle and associated golf club shaft into the hollow plastic tube. The flexible restricted throat element subsequently returns to its initial shape for close fitting circumferential support of the golf club hosel at an upper end of the golf club shaft adjacent the golf club head. The predetermined diameter of the hollow plastic tube is dimensioned to at least substantially peripherally engage the golf club handle at least adjacent the open lower end. The entire length of the golf club shaft is thus protected by the hollow plastic tube through the circumferential support of the golf club hosel by the flexible restricted throat opening at the open upper end and by the at least substantial peripheral engagement of the golf club handle at the lower open end so as to provide suspended non-engagement of the golf club shaft therebetween.

3 Claims, 2 Drawing Sheets

GOLF CLUB SHAFT PROTECTOR

BACKGROUND OF THE INVENTION

This invention relates to a golf club shaft protector, and more particularly to a hollow plastic tube of predetermined diameter and length that provides suspended non-engagement of the golf club shaft adjacent the opposite open upper and lower ends of the hollow plastic tube.

Golfers have historically experienced problems in the care and management of their golf clubs during use and travel. As will be appreciated, golf clubs are subject to rough handling during use and travel, which can lead to early and unexpected damage and deterioration. Some recent developments have resulted in better golf clubs, but have produced unexpected early damage or deterioration. For example, golf clubs with expensive graphite, titanium and other exotic golf club shafts have functioned extremely well on the golf course, but can be quickly damaged simply by inserting and removing a golf club from a golf bag.

Golf club heads are conventionally protected by a variety of different golf club covers, but there has never been an acceptable device for protecting golf club shafts. Others have tried to develop an acceptable commercial product. For example, there have been several different types of protective tubes and narrow elongated containers which have been developed for the express purpose of protecting golf club shafts. Such devices are shown in U.S. Pat. Nos. 3,985,229; 4,664,382; 4,932,523; 4,938,349 and 5,088,600. Each of these patents disclose a variety of different devices designed to protect golf club shafts from damage or deterioration during use and travel. While certain features of these patented devices are very desirable, as a whole, they have failed to take into consideration the practical as well as economical aspects that must be considered in designing a golf club shaft protector. As will be discussed in detail below, the present invention overcomes the problems associated with the prior art, while providing an extremely practical, reliable and economical golf club shaft protector.

SUMMARY OF THE INVENTION

Among the several objects and advantages of the present invention include:

The provision of a new and improved golf club shaft protector which protects essentially the entire golf club shaft below the golf club head;

The provision of the aforementioned golf club shaft protector which suspends the shaft from the inside of a hollow tube substantially between the golf club shaft handle and the golf club head;

The provision of the aforementioned golf club shaft protector which provides circumferential support of a golf club shaft at an upper end and at least substantial peripheral engagement of a golf club handle at a lower end for suspended non-engagement of substantially the entire golf club shaft within the golf club shaft protector;

The provision of the aforementioned golf club shaft protector wherein the upper end of a hollow plastic tube includes a flexible restricted throat element for resilient deformation and return following insertion of a golf club handle and associated golf club shaft therethrough;

The provision of the aforementioned golf club shaft protector which includes a tubular member with a flexible end section that fits over the open upper end of a hollow plastic tube and includes the aforementioned flexible restricted throat element;

The provision of the aforementioned golf club shaft protector including a hollow plastic tube with a self-sustaining wall thickness that is also sufficiently thin enough to permit cutting of the hollow plastic tube in desired pre-selected lengths; and The provision of the aforementioned golf club shaft protector which is simply and easily constructed by known manufacturing techniques, is easy to use and maintain, is practical for typical golfer use, is extremely economical and is otherwise well adapted for the purposes intended.

Briefly stated, the golf club shaft protector of the present invention includes a hollow plastic tube of predetermined diameter and length with open upper and lower ends. The predetermined length of the hollow plastic tube substantially corresponds to the length of the golf club shaft. A flexible restricted throat element extends across the open upper end of the hollow plastic tube for resilient deformation upon the insertion of a golf club handle to allow passage of the golf club handle and associated golf club shaft therethrough and into the hollow plastic tube. The flexible restricted throat element provides subsequent resilient return to its initial shape for close fitting circumferential support of the golf club hosel adjacent the golf club head. The predetermined diameter of the hollow plastic tube is dimensioned to at least substantially peripherally engage the golf club handle at least adjacent the open lower end. The entire length of the golf club shaft, from the hosel to the handle grip, is protected by the hollow plastic tube through the circumferential support of the golf club shaft by the flexible restricted throat element at the open upper end and by the at least substantial peripheral engagement of the golf club handle at the lower open end, thus providing suspended non-engagement of the golf club shaft therebetween.

The flexible restricted throat element includes circumferentially arranged flexible lip sections extending across the open upper end of the hollow plastic tube. Each of the flexible lip sections are arranged in circumferentially adjacent positions to at least one other flexible lip section and also extends radially inwardly to collectively define an opening of predetermined smaller dimension than the hollow plastic tube. Each of the flexible lip sections terminate in a generally downwardly projecting lip adjacent the opening of predetermined smaller dimension. Preferably, there are three circumferentially arranged lip sections each having a generally downwardly projecting lip.

At the open upper end of the hollow plastic tube, a tubular member is provided. The tubular member includes an end section with flexible lip sections that extend over the open upper end of the hollow plastic tube and a tubular extension that extends a predetermined distance downwardly along the length of the hollow plastic tube. The tubular extension of the tubular member resiliently engages and grips the hollow plastic tube in substantial tight fitting engagement therewith. Preferably, the hollow plastic tube is formed from polypropylene while the tubular member is formed from polyvinyl chloride.

The hollow plastic tube has a self-sustaining wall thickness that is also sufficiently thin enough to permit cutting of the hollow plastic tube to the desired preselected length.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptions, variations, alternatives and uses of the invention, including what we presently believe is the best mode of carrying out the invention.

Figure 1:
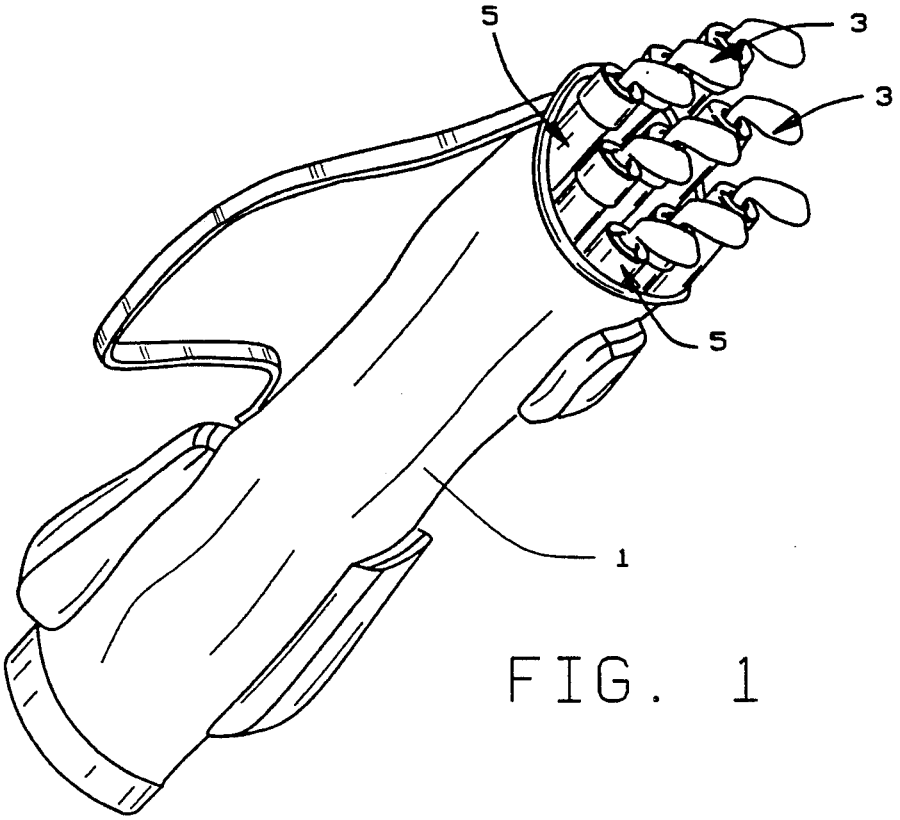
FIG. 1 is a perspective view illustrating a typical golf club bag with golf clubs positioned in the golf club shaft protector of the present invention.

As illustrated in FIG. 1 of the drawings, a typical golf club bag 1 is shown with a plurality of golf clubs inserted in a corresponding number of golf club shaft protectors 5. Each of the golf club shaft protectors 5 are constructed to support a single golf club 3, there being a corresponding number of golf club shaft protectors 5 in the golf club bag 1 for each of the golf clubs 3.

Figure 2:
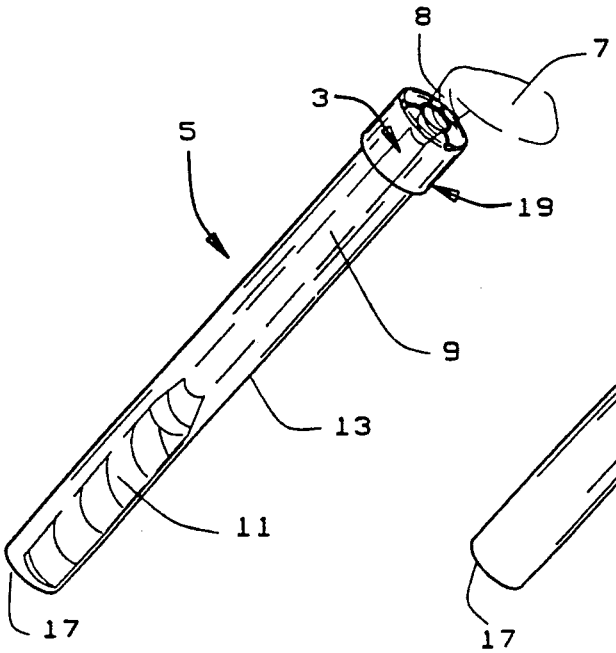
FIG. 2 is a perspective view of the golf club shaft protector of the present invention with a golf club shown in phantom lines positioned therein.

As shown in FIG. 2 of the drawings, the typical golf club 3 includes a golf club head 7, an elongated flexible shaft 9 and a handle 11 at the end of the golf club shaft 9 opposite the golf club head 7. The golf club shaft protector 5 of the present invention is constructed to provide substantial protection against unexpected damage or deterioration to the golf club shaft 9 from the hosel 8 adjacent the golf club head 7 to the golf club handle 11. The hosel 8 is a tapered wrapped or wound section about three inches long located beneath the golf club head 7 at the upper end of the golf club shaft 9. As will be appreciated, the golf club head 7 is typically protected by golf club covers, and with this invention, the golf club shaft protector 5 provides protection for the golf club shaft 9, from the hosel 8 to the handle 11, as described in detail below.

Figure 3:
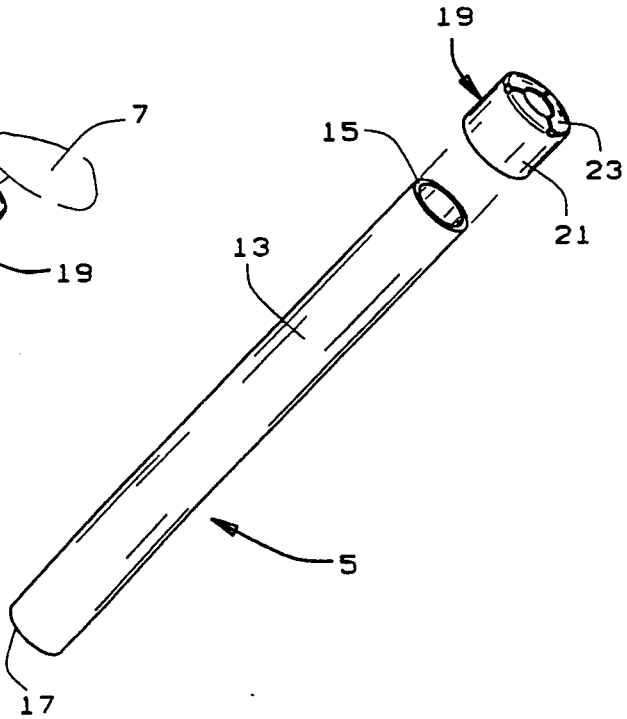
FIG. 3 is an exploded perspective view of the components which comprise the golf club shaft protector of the present invention.

In FIG. 3 of the drawings, the golf club shaft protector 5 is shown as comprising a hollow plastic tube 13 that can be formed from many suitable plastic materials, polypropylene being one preferred example. The hollow plastic tube 13 has a predetermined diameter and length with open upper and lower ends 15, 17, respectively. The predetermined length of the hollow plastic tube 13 substantially corresponds to the length of a golf club shaft 9. The hollow plastic tube 13 has a self-sustaining wall thickness that is also sufficiently thin enough to permit cutting of the hollow plastic tube 13 to the desired length. Thus, a user may cut the hollow plastic tube 13 at a desired point upwardly from the lower open end, depending on the length of the user's wood and iron golf clubs.

Figure 4:
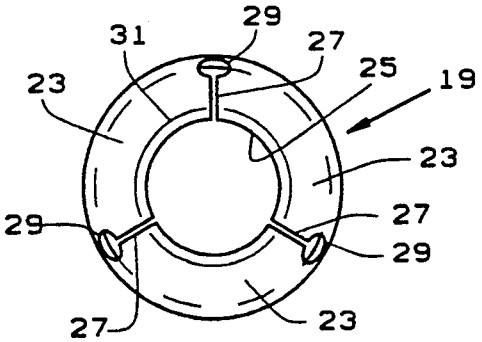
FIG. 4 is an enlarged top plan view of the open upper end with the flexible restricted throat element.
Figure 5:
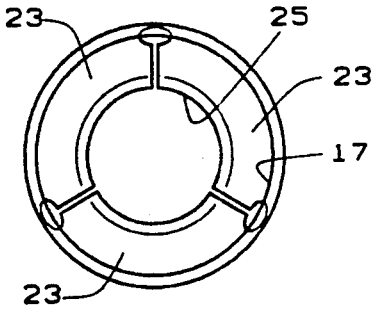
FIG. 5 is an enlarged bottom plan view of the golf club shaft protector.
Figure 6:
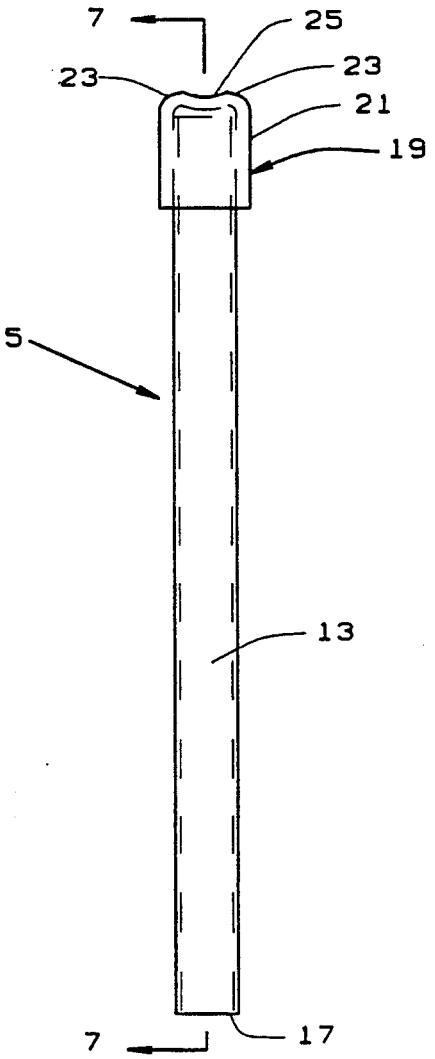
FIG. 6 is a side elevational view of the golf club shaft protector of the present invention.
Figure 8:
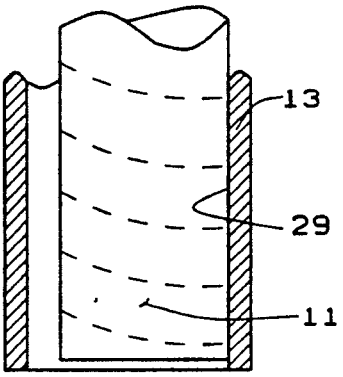
FIG. 8 is an enlarged fragmentary cross-sectional view illustrating in phantom lines the manner in which a golf club at least substantially peripherally contacts a substantial inner curvilinear portion of the golf club shaft protector at its lower end.

A flexible tubular member 19, preferably formed from a flexible and resilient material such as polyvinyl chloride, is telescopically mounted over the open upper end 15 of the hollow plastic tube. The tubular member 19 includes a tubular wall 21 that is dimensioned to resiliently engage and grip the hollow plastic tube 13 in tight fitting engagement immediately below the open upper end 15. The tubular member 19 further includes an end section with a series of circumferentially arranged lip sections 23. As best seen in FIG. 4 of the drawings, each of the flexible lip sections 23 are arranged in circumferentially adjacent position to each other and extend radially inwardly to collectively define an opening 25 of predetermined smaller dimension than the internal diameter of the hollow plastic tube 13. The flexible lip sections 23 are formed by a series of radially extending slots 27 within an enlarged oblong shaped opening 29 at the outermost end of the elongated slots 27. Because the tubular member 19 is made from a flexible and resilient material such as polyvinyl chloride, each of the flexible lip sections 23, together with the slots 27, provide a flexible, yet restricted throat element, for purposes presently to be described. Each of the flexible lip sections 23, adjacent the open 25 of predetermined smaller dimension, also terminate in a tapered or generally downwardly projecting lip 31.

Figure 7:
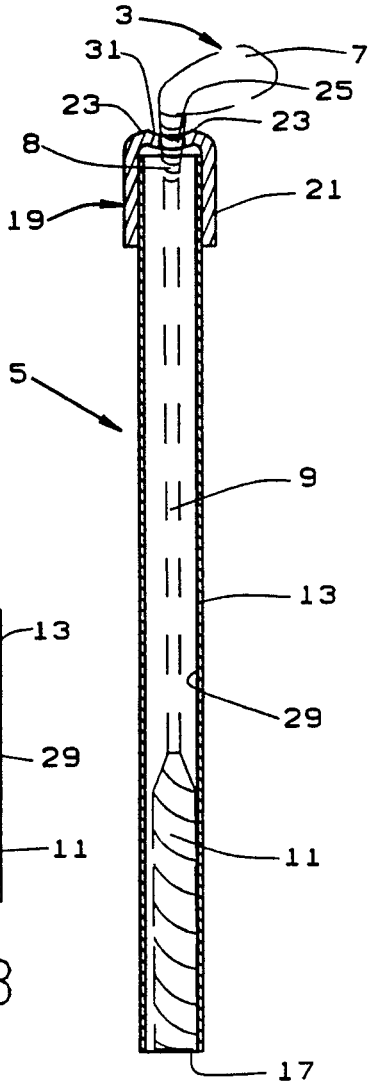
FIG. 7 is a sectional view of the golf club shaft protector shown along lines 7-7 of FIG. 6 and illustrating in phantom lines the manner in which a golf club is mounted and supported with respect thereto.

The flexible restricted throat element, formed by the circumferentially arranged flexible lip sections 23, extends across the open upper end 15 of the hollow plastic tube 13 for resilient deformation upon the insertion of a golf club handle 11 and associated golf club shaft 9 therethrough and into the hollow plastic tube, as illustrated in FIGS. 2 and 7 of the drawings. Once the golf club handle 11 and golf club shaft 9 are positioned as illustrated in FIGS. 2 and 7 of the drawings, the flexible restricted throat element resiliently returns to its initial shape for close fitting circumferential support of the golf club hosel 8 adjacent the golf club head 7. In this respect, the downwardly projecting or tapered lip 31 at the inner end each of the flexible lip sections 23 may either engage or be substantial close fitting engagement with the golf club 8 for circumferential support of the golf club shaft 9 ad the golf club head 7.

The predetermined diameter of the hollow tube 13 is dimensioned such that the golf club handle 11 is in at least substantial peripheral engagement or partial peripheral engagement on one side of the inner wall 29 of the hollow plastic tube 13, at least adjacent the open lower end 17. In some instances, the golf club handle 11 will engage a substantial predetermined length of the inner wall 29 from adjacent the lower open end 17; however, as long as the outermost end of the golf club handle 11 (where it is typically the largest) at least substantially peripherally engages or partially peripherally engages the inner wall 29 of the hollow plastic tube 13, the desired support of the golf club shaft 9 will be provided.

Specifically, substantially the entire length of the golf club shaft 9, from the hosel 8 to the club handle 11, is protected by the hollow plastic tube 13 through the circumferential support of the golf club hosel 8 by the flexible restricted throat element at the open upper end 15 of the hollow plastic tube 13 and by the substantial peripheral or partial peripheral engagement on one side of the golf club handle 11 at least at the lower open upper end of the hollow plastic tube 13. This provides suspended non-engagement of the golf club shaft 9 between the upper circumferential support of the golf club hosel 8 and the lower peripheral engagement of the golf club handle 11, as described.

From the foregoing, it will be appreciated that the golf club shaft protector 5 of the present invention provides circumferential support of a golf club hosel 8 adjacent the golf club head 7 at an upper end and at least substantial peripheral engagement or partial peripheral engagement on one side of the golf club handle 11 at a lower end for suspended non-engagement of substantially the entire golf club shaft 9 within the hollow plastic tube 13. The flexible resilient throat element is resiliently deformed upon the insertion of a golf club handle 11 and resiliently returns to its initial shape for substantial close fitting or substantial close fitting circumferential support of the golf club hosel 8 adjacent the golf club head 7. The golf club handle 11 is at least substantially peripherally engaged or partially peripherally engaged on one side by an inner wall of the hollow plastic tube at least adjacent the lower end, thus providing with the upper circumferential support, the suspended non-engagement of the golf club shaft 9 therebetween.

In view of the above, it will be seen that the several objects and features of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

We claim:

1. A golf club shaft protector comprising:

a hollow plastic tube of predetermined diameter and length with open upper and lower ends, the predetermined length of said hollow plastic tube substantially corresponding to the length of a golf club shaft;

a flexible restricted throat element extending across the open upper end of said hollow plastic tube for resilient deformation upon the insertion of a golf club handle to allow passage of the golf club handle and associated golf club shaft therethrough and into the hollow plastic tube, said flexible restricted throat element providing subsequent resilient return to its initial shape for close fitting circumferential support of a golf club hosel at an upper end of the golf club shaft adjacent the golf club head, said flexible restricted throat element including circumferentially arranged flexible lip sections extending across the open upper end of the hollow plastic tube, each of the flexible lip sections being arranged in circumferentially adjacent position to at least one other flexible lip section and extending radially inwardly to collectively define an opening of predetermined smaller dimension than the hollow plastic tube, each of said flexible lip sections terminating in a generally downwardly projecting lip adjacent the opening of predetermined smaller dimension, the circumferentially arranged flexible lip sections forming an integral part of a tubular member defining an end section that includes such flexible lip sections which extend over the open upper end of the hollow plastic tube and a tubular wall section that extends a predetermined distance downwardly along an outside surface of the hollow plastic tube, the tubular wall section of the tubular member resiliently engaging and gripping the hollow plastic tube in substantial tight fitting engagement; and the predetermined diameter of the hollow plastic tube being dimensioned to at least substantially peripherally engage the golf club handle at least adjacent the open lower end, whereby substantially the entire length of the golf club shaft is protected by the hollow plastic tube through the circumferential support of the golf club hosel by the flexible restricted throat element at the open upper end and by the at least substantial peripheral engagement of the golf club handle at the lower open end providing suspended non-engagement of the golf club shaft therebetween.

2. The golf club shaft protector as defined in claim 1 wherein the hollow plastic tube has a self-sustaining wall thickness that is also sufficiently thin enough to permit cutting of the hollow plastic tube to the desired length.

3. The golf club shaft protector as defined in claim 2 wherein the hollow plastic tube is formed from polypropylene and the tubular end section is formed from polyvinyl chloride.

* * * * *